US007036532B2

(12) United States Patent
Bauder et al.

(10) Patent No.: US 7,036,532 B2
(45) Date of Patent: May 2, 2006

(54) SPRING DAMPENED SHEDDING DEVICE

(75) Inventors: Hans-Jürgen Bauder, Reutlingen (DE); Helmut Weinsdörfer, Pliezhäusen (DE)

(73) Assignee: Deutsch Institute fur Faserforschung, Denkendorf (DE)

( * ) Notice: Subject to any disclaimer, the term of this patent is extended or adjusted under 35 U.S.C. 154(b) by 0 days.

(21) Appl. No.: 10/477,652

(22) PCT Filed: Mar. 15, 2002

(86) PCT No.: PCT/DE02/00958

§ 371 (c)(1),
(2), (4) Date: Apr. 26, 2004

(87) PCT Pub. No.: WO02/092892

PCT Pub. Date: Nov. 21, 2002

(65) Prior Publication Data

US 2004/0168735 A1 Sep. 2, 2004

(30) Foreign Application Priority Data

May 17, 2001 (DE) ..... 101 24 022

(51) Int. Cl.
*D03C 7/00* (2006.01)

(52) U.S. Cl. ..... 139/52; 139/93

(58) Field of Classification Search ..... 139/85, 139/88–89, 91–93, 51–53, 59; 24/625, 298; 188/378, 379

See application file for complete search history.

(56) References Cited

U.S. PATENT DOCUMENTS 5,819,809 A * 10/1998 Bassi et al. ..... 139/85
6,302,154 B1 * 10/2001 Bassi et al. ..... 139/85

* cited by examiner

*Primary Examiner*—John J. Calvert
*Assistant Examiner*—Andrew W. Sutton
(74) *Attorney, Agent, or Firm*—Leydig, Voit & Mayer, Ltd.

(57) ABSTRACT

A shedding device in a jacquard loom, having a heddle with a retracting spring rigidly anchored in the loom or to the floor for urging the heddle to a lower shed forming position. To suppress the development of resonance in the spring, a core element is provided, which contacts the inside of the spring at points spaced apart from one another and forces the spring to take a course which deviates from the rectilinear. As a result, friction forces that contribute to damping the spring motion are created between the spring and the core element.

29 Claims, 6 Drawing Sheets

SPRING DAMPENED SHEDDING DEVICE

FIELD OF THE INVENTION

The present invention relates generally to weaving looms, and more particularly to a spring controlled drive for reciprocating the heddle of such weaving looms.

BACKGROUND OF THE INVENTION

In weaving looms, and particularly in jacquard looms, heddles are moved in one direction while being pulled by a spring in the other direction. Generally, the heddle is moved by the spring to form the lower shed. The spring is anchored at its opposite end in stationary fashion in the loom or to the floor and keeps a harness cord and the heddle under tension during their operation.

Like any spring-elastic system, the assembly comprising the spring, heddle and harness cord also exhibits a resonance phenomena, including the propagation of undulations that pass through the linear system. The natural resonance of the system does not matter, as long as the rate of motion of the heddle is low compared to the resonant frequency. However, at the moment when the rate of motion of the heddle reaches the range of the resonant frequency, unwanted undulations occur in the spring. The undulations are induced in the spring by the motion of the heddle, and they travel toward the fixed end, where they are reflected and run back toward the heddle.

Under unfavorable circumstances, the heddle can even lose tension, since the returning undulation in the connection between the spring and the heddle has a phase relationship counter to the motion initialized by the motion of the harness cord.

The resonance inside the spring also causes increased mechanical stress and premature breakage.

To damp the resonance in the spring, it is known from European Patent Disclosure EP 0 678 603 to provide the lower spring fastening point with a damping device. The lower spring fastening point comprises a plastic molded part with a threaded peg onto which the helical spring is screwed. The threaded peg has two legs on its free end that are spring-elastically moveable counter to one another and which protrude into the interior of the spring and press against the spring. On the end remote from the threaded peg, the two legs are joined together again and merge with two further legs, which form an open fork.

It has been found that this type of spring damping is not unproblematic. If the contact pressure with which the legs act against the inside of the spring windings is too hard, no effective damping action occurs. Instead, the arriving undulations are reflected, largely unattenuated, at those points where the legs touch the inside of the spring. Conversely, if the contact pressure is too low, once again adequate damping does not ensue. This unfavorable phenomenon is reinforced by the fact that the spring elasticity of the plastic can exhibit fatigue and is also temperature-dependent. Furthermore, it is difficult to thread the open ends of the legs into the spring.

OBJECTS AND SUMMARY OF THE INVENTION

It is an object of the present invention to provide a loom shedding device in which the retraction spring is anchored in a manner that more effectively dampens undesirable resonating propagations of the spring during operation of the shedding device.

As in the prior art, the heddle of the shedding device according to the invention is kept taut between the harness cord and the helical spring. The end of the helical spring remote from the heddle is anchored in stationary fashion. To achieve the desired damping, there is a damping element, which at least at a plurality of spaced-apart points is in contact with the helical spring and imposes a nonrectilinear course or shape to the originally straight helical spring. In this way, the helical spring is in contact with the damping element at points spaced apart from one another. The contact force of the helical spring on the damping element is determined by the intrinsic elasticity of the spring and by the extent of the deflection. Conversely, the elasticity of the damping element plays practically no role.

Because of the essentially point-type contact between the helical spring and the damping element, some of the vibration energy at every point of contact can be converted into friction. The reflections of the mechanical undulation that occur at the contacting points are quantitatively too slight to be capable of generating a significant returning undulation that could cause springs to break. Between the contacting points, conversely, the spring extends somewhat freely.

Since the extent to which the spring is pressed against the damping element depends only on the geometric extent of the nonrectilinear course that the helical spring assumes because of the damping element, very precisely replicable contact pressures are achieved. The modulus of elasticity of the steel helical spring is far less temperature-dependent than the modulus of elasticity of plastic, and moreover, the modulus of elasticity also varies less over time.

Finally, practically no permanent deformation occurs in the steel spring since it gradually adapts to the nonrectilinear course of the damping element. The damping element, conversely, compared to the resilience of the helical spring, need not have any elasticity at all. Relative to the force exerted by the helical spring, the damping element can be sufficiently rigid that it is not pressed into a different shape by the helical spring. In this way, it is possible to generate very precise replicable contact pressures and thus very precise replicable friction forces between the spring and the damping element.

In particular, it is possible to cause the damping element to interact with the helical spring over a comparatively very long distance. Moreover, it is possible for the extent of deformation, that is, the wavelength and/or the amplitude that the damping element imposes on the helical spring, to vary over the length of the damping element. In this way, increasing damping or bunching of the vibration can be attained. In the direction of the heddle, the damping element is initially deformed relatively little out of the rectilinear course, and the deformation increases toward the anchoring end of the helical spring. Very good damping with only very slight dispersion is attained at the damping element.

The damping element is preferably a linear core element, which is disposed in the helical spring. This saves additional space for the damping element because it is disposed at a location that is necessarily present anyway.

To achieve the desired deformation, the core element can have a course or shape that deviates from a rectilinear course. Another option is to use an intrinsically rectilinear core element, which has discretely distributed, bumplike protrusions or humps spaced apart from one another, with which the desired nonrectilinear course is imposed on the helical spring. The diameter in the region of the protrusion or hump is less than the inside width of the helical spring.

The core element with a nonlinear course essentially has a cylindrical configuration with an undulating course or shape. The undulations expediently define a straight regression line, so that on average, a straight course of the spring comes about.

The undulating course can occur because the core element forms a helix, or because the core element forms undulations that are located in the same plane.

In each case, a projection of the core element on a plane generates a band with an undulating course, whose width is equivalent to the diameter of the core element and whose undulating nature essentially matches the undulating or helical course of the core element. The dimensions of the undulating course are expediently defined at this band created by projection in the plane. In the projection, the undulating course can be seen to have an undulation depth, measured on one edge of the band, between a crest and a trough of between 0.1 and 3 mm. The magnitude of this undulation rise depends on the ratio of diameters between the core element and the inside width of the helical spring and on how strongly the helical spring is deflected or is to be pressed against the core element. The spacings between the crest and trough can range between 2 and 20 mm.

In the case where protrusions or humps are used, they can be disposed along a helical line, or in the simplest case along a zigzag; that is, each two adjacent protrusions are located on opposite sides relative to the core element. The spacing between protrusions is in the range between 5 mm and 30 mm, and preferably between 5 mm and 20 mm.

The protrusions or humps preferably are integral with the core element and can be formed on either by injection molding or in some other way depending on the manner in which the core element is produced. Another option is to create the humps by local deformation, such as by crimping to form ears. This last option is attractive if the core element comprises a permanently deformable material, such as metal.

The length of the core element is such that at least one complete undulation with the above dimensions can be generated. The core element can rest loosely in the helical spring or can be joined solidly to the lower anchoring means.

Thermoplastics such as polyamide, polyethylene and polyurethane, or such other materials as metal, ceramic, pressure-setting plastics or vulcanizable materials, can be considered as material for the core element.

The shedding device of the invention is preferably employed in jacquard looms. Because of its very good damping action and the little space required, however, the arrangement according to the invention is not limited to jacquard looms, but can also be employed in normal looms for producing unpatterned woven fabrics, or heddle machines. Accordingly, the shedding device is also for instance a heddle machine, a jacquard loom, or a comparable drive device for setting the heddles in motion.

To connect the heddle to the helical spring, the heddle can be provided on the applicable end of the heddle shaft with a plastic molded part, which by way of example has a thread that can be screwed into the helical spring. Connecting the helical spring to the lower or upper anchoring element can be done as in the prior art.

Other objects and advantages of the invention will become apparent upon reading the following detailed description and upon reference to the drawings, in which:

Figure 1:
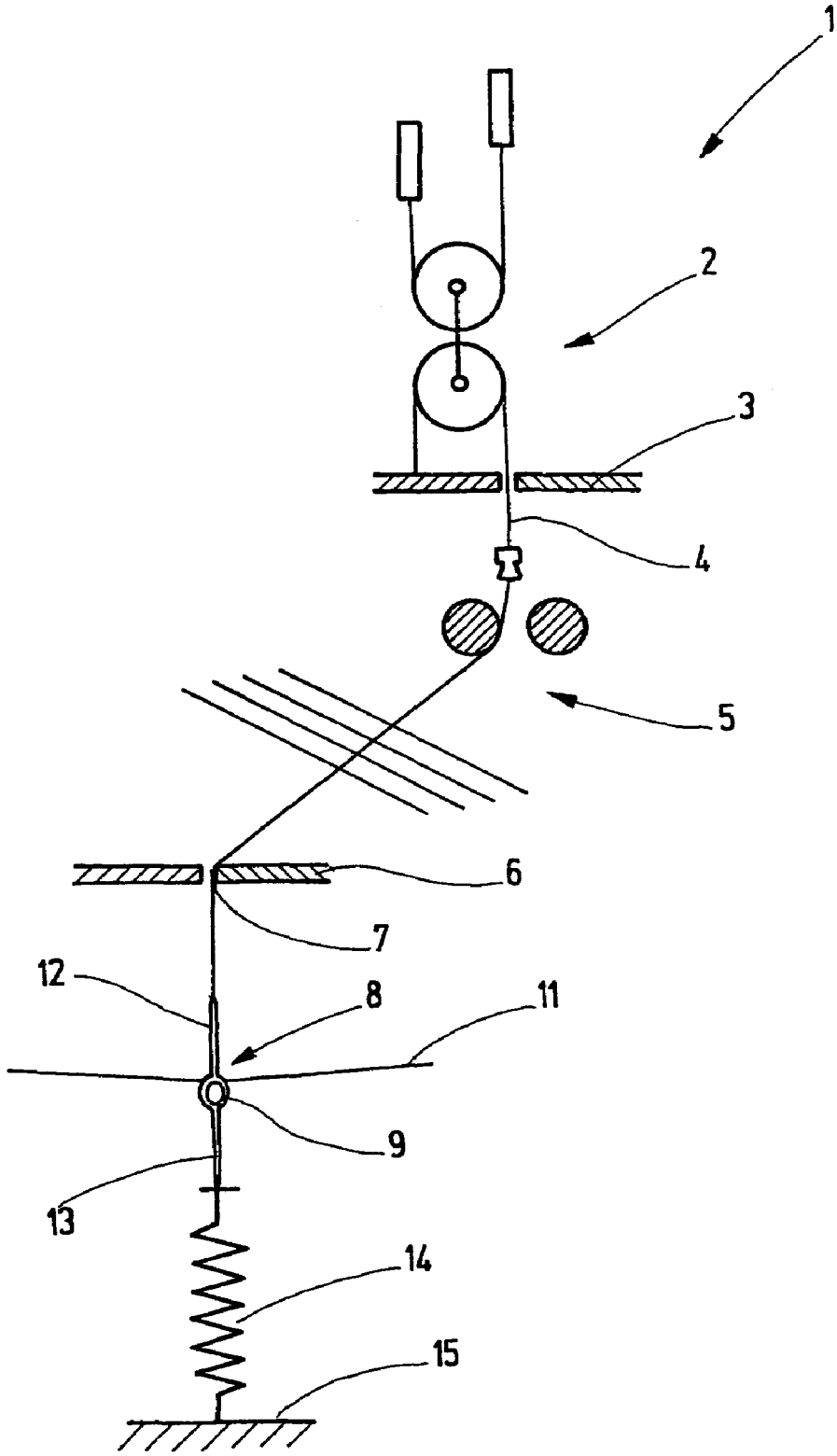
FIG. 1 is a schematic of an illustrated shedding device in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to FIG. 1 of the drawings, there is shown an illustrative shedding device in accordance with the invention in a jacquard loom. The shedding device includes a drive device which includes a roller train 2 as illustrated. From the roller train 2, a collet cord secured to a collet floor 3 extends and changes into a harness cord 4 that passes between a glass grate or a guide floor 5. The harness cord 4 travels on to a harness board 6, where it emerges at the bottom through a bore 7. On the lower end, that is, the end of the harness cord 4 that is remote from the roller train 2, a heddle 8 is secured. The heddle 8 has an eyelet or eye 9 for a warp thread 11. From the eye 9, upper and lower heddle shafts 12, 13 extend, located on the same straight line. The lower end of the lower heddle shaft 13 is connected to a retracting spring 14, which is anchored at 15 to the machine frame or to the floor.

The motion of the roller train 2 is transmitted to the heddle 8 via the harness cord 4. As a result, the harness cord 4 is pulled upward, and the eye 9 is pulled upward out of its neutral position to form the upper shed. This tenses the retracting spring 14 more strongly than in the neutral position of the heddle 8, which is equivalent to the closed shed. When the harness cord 4 is let down, the retracting spring 14 pulls the heddle 8 downward to the same extent as the harness cord 4 moves downward. As a result, the applicable warp thread 11 forms the lower shed.

As readily seen, the upward motion of the heddle 8 is a compulsory motion, which is imposed rigidly by way of the harness cord 4, which cannot stretch in the longitudinal direction. The opposite direction, conversely, is a motion brought about by the retracting spring 14 and in this sense is only conditionally compulsory.

Figure 2:
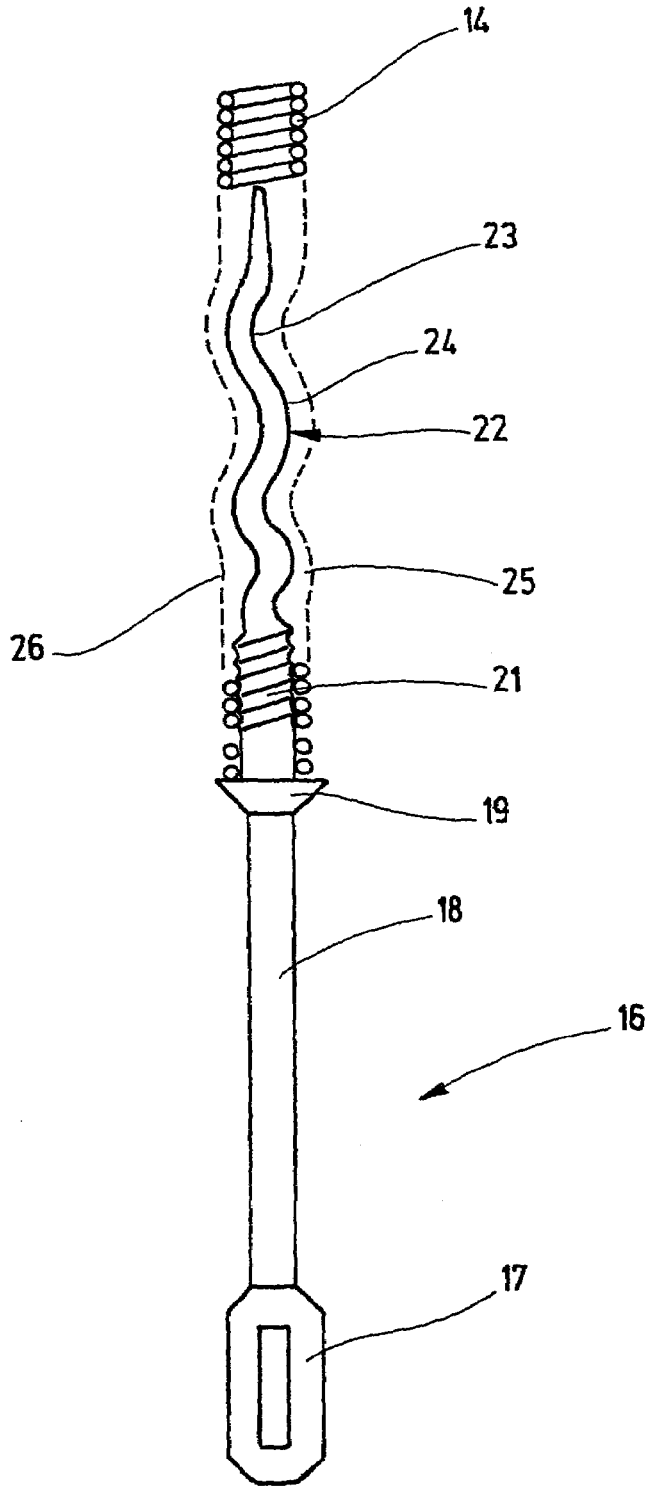
FIG. 2 is an enlarged side elevational view of the core element of the illustrated shedding device.

The configuration comprising the harness cord 4, heddle 8, warp thread 11 and retracting spring 14 is a spring mass system that has one or more resonant frequencies. At high machine speeds, the frequency at which the heddle 8 is moved out of the neutral position with the shed closed into the position for the upper shed or into the position for the lower shed is approximately 10 Hz. These frequencies, which are imposed by the drive system 1, are on the order of magnitude of the resonant frequencies of the entire system, or the resonant frequency of partial systems. Moreover, harmonics also occur, and at these frequencies, undulations develop in the linear configuration between the harness board 6 and the anchoring point 15 in the retracting spring 14, and if appropriate countermeasures are not taken, they are reflected at the anchoring point 15 and become standing waves in the retracting spring 14. As a result, the retracting spring 14 is extremely severely stressed at certain points and tends toward breakage. In accordance with the invention, a retracting spring of the shedding device is anchored in a manner that more effectively dampens resonating propagations in the spring during operation of the shedding device. In the illustrated embodiment, the lower end of the retracting spring 14 is connected to an anchoring element 16, as best depicted in FIG. 2, which in this case has a rod-like form thread. The anchoring element 16 has an eyelet 17 on its lower end that can be secured to a suitable rail mounted in fixed fashion to the machine frame. An essentially cylindrical shaft 18 extends from the eyelet 17 and is provided with a collar 19 on its upper end. A male-threaded peg 21 extends above the collar 19, concentrically to the shaft 18, onto which the spring is screwed. The male-threaded peg in this instance has a length equivalent to approximately ten spring windings. The retracting spring 14 is a cylindrical spring, wound of cylindrical steel wire, in which the windings in the relaxed state typically rest on one another.

On its free end, the threaded peg 21 changes into a core element 22, which as shown has a nonrectilinear course or shape formed with troughs 23 and crests 24. It is deformed in such a way that the surface defined by the troughs and crests defines a plane. This means that in a side view rotated 90°, compared to FIG. 2, the core element 22 has a straight course or length.

As can readily be seen, the trough 23 on the opposite side of the core element 22 leads to a crest, like the crest 24, which in the correspondingly opposite direction deforms the spring 14.

The core element 22 has a circular cross section at all points, and the diameter of the cross section is less, by about 5 to 30%, than the inside diameter of the helical spring 14. The diameter of the core element 22 can be constant over its length or can decrease toward the tip. The core element 22 preferably is injection-molded in one piece from plastic along with the threaded peg 21, shaft 18 and eyelet 17. Suitable plastics are polyamide, polyethylene, polyurethane, and polyester.

The undulating course that the core element 22 is so pronounced that the troughs and crests 23, 24 impose a corresponding course on the helical spring. Hence, the helical spring 14 no longer extends rectilinearly in the region of the core element but instead has a zigzag shape that corresponds to the core element 22, as represented by the dashed lines 25 and 26. The lateral deflection of the spring 14 is lessened in accordance with the difference in diameter between the outside diameter of the core element 22 and the inside width of the helical spring 14.

The form of the illustrated core element 22, as depicted in FIG. 2, is equivalent to a projection of the core element 22 onto a plane, specifically a projection in which the undulating band generated by the projection has the greatest amplitude. If each of the boundary lines thus obtained is considered to be the course of a vibration, the amplitude of the vibration from tip to tip is about 0.1 to 3 mm, and preferably 0.1 to 1 mm, while the wavelength of the vibration is between about 4 and 40 mm; although both values can vary along the length of the core element 22.

The amplitude of the undulating line, that is, the extent of lateral deflection, can increase from the free end of the core element 22 to the threaded peg 21. As a result, the windings of the spring 14 rest on the first crest of the core element with relatively lower lateral force because it is not deformed as much as at a crest that is located closer to the threaded peg 21.

Figure 3:
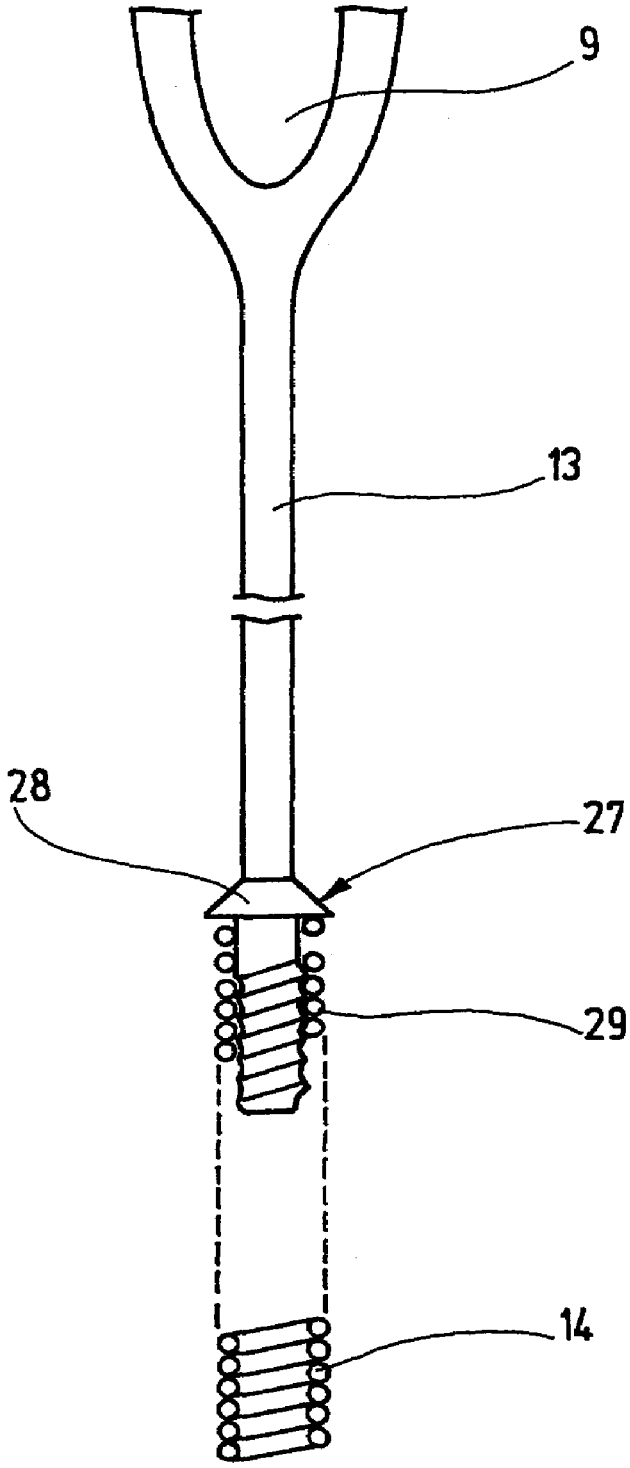
FIG. 3 is a depiction of an upper connection between a heddle shaft and a retracting spring of the illustrated device.

The connection between the lower heddle shaft 13 and the retracting spring 14 is shown in FIG. 3. As can be seen there, a plastic molded part 27 is formed onto the free end of the heddle shaft 13 and corresponds in terms of its structure to the collar 19 of the anchoring element 16. The plastic molded part in this instance forms a collar 28 and also a threaded peg 29 that extends coaxially to the heddle shaft 13. The threaded peg 29 has a male thread, which may be cylindrical or tapered, onto which the retracting spring 14 is screwed, as described above, until the end strikes the collar 28, as shown.

The mode of operation of the core element 22 as a damping member in the spring 14 is approximately as follows:

When an impact is introduced from the upper end of the retracting spring 14 through the heddle 8, the impact travels as a longitudinal wave over the taut retracting spring in the direction of the anchoring element 16. In normal operation, care is taken to assure that the spring windings of the retracting spring 14 will not rest on one another in any operating situation. As a result of the impact wave, however, such contact can certainly occur.

In every case, the impact wave travels through the spaced apart windings of the spring, which now correspondingly reach the core element 22. Between the applicable moving spring windings and the respective crest 23, 24 of the core element, friction occurs. The friction converts the energy of motion of the spring windings into heat and thus draws energy from the system. Excessive increases in amplitude caused by resonance are effectively suppressed. In particular, the damping assures that an impact wave traveling in the direction of the threaded peg 21 will reach the end of the helical spring 14 that is fixed to the threaded peg 21 only in attenuated form and will cause a corresponding echo of reduced amplitude, which in turn is further attenuated in its return travel along the core element.

In this way, the core element 22 effectively assures a suppression of standing waves on the retracting spring 14. The damping action by the core element 22, whose total length is between 5% and 40%, preferably 10% and 30%, of the retracting spring 14 that is taut in operation, also assures that longer-frequency waves are effectively damped in order to suppress the development of standing waves whose wavelength is on the order of magnitude of the taut spring.

For assembly reasons, the core element 22 preferably should integrally join the threaded peg 21. However, there is no necessity to do so. On the contrary, for producing its damping action, the core element can be provided at an arbitrary point. Alternatively, the core element 22 could be integrally connected to the anchoring member 27, by which the lower heddle 13 is coupled to the retracting spring 14.

Figure 4:
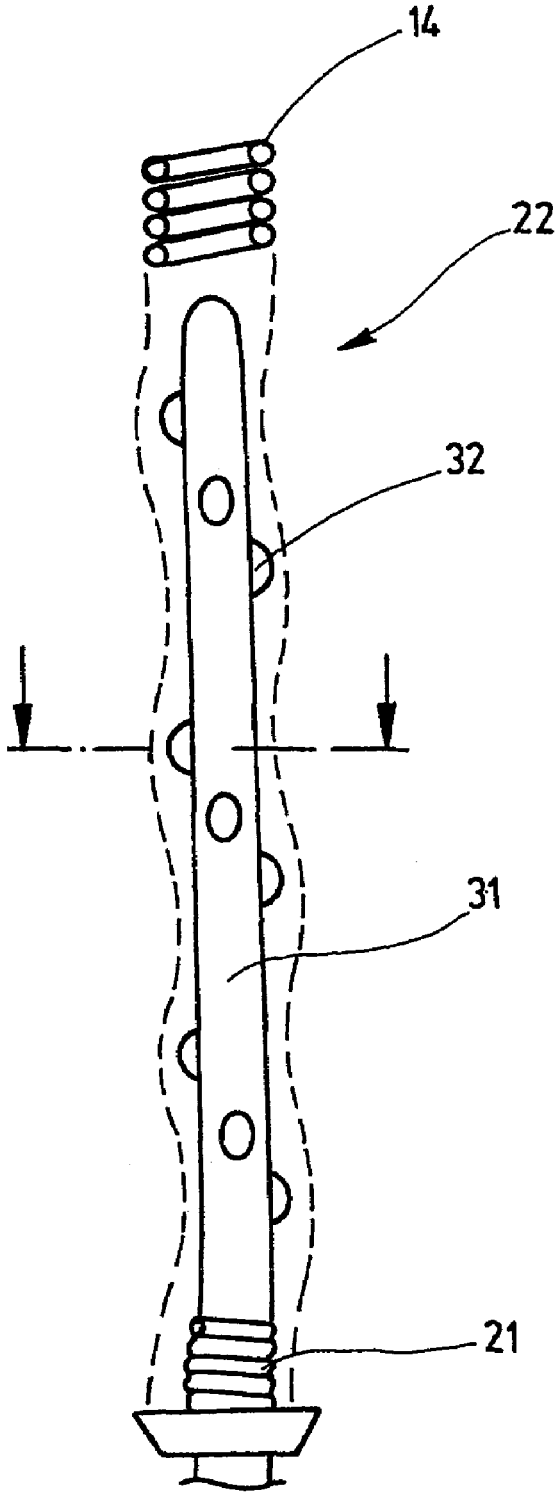
FIG. 4 is an enlarged view of an alternative embodiment of core element formed with lateral protrusions.

Another exemplary embodiment of a core element 22 is depicted in FIG. 4, which serves to impose a nonrectilinear course on the helical spring 14, and at the same time, only point contact comes about between the core element 22 and the helical spring 14 in generating the above-described damping action.

Figure 5:
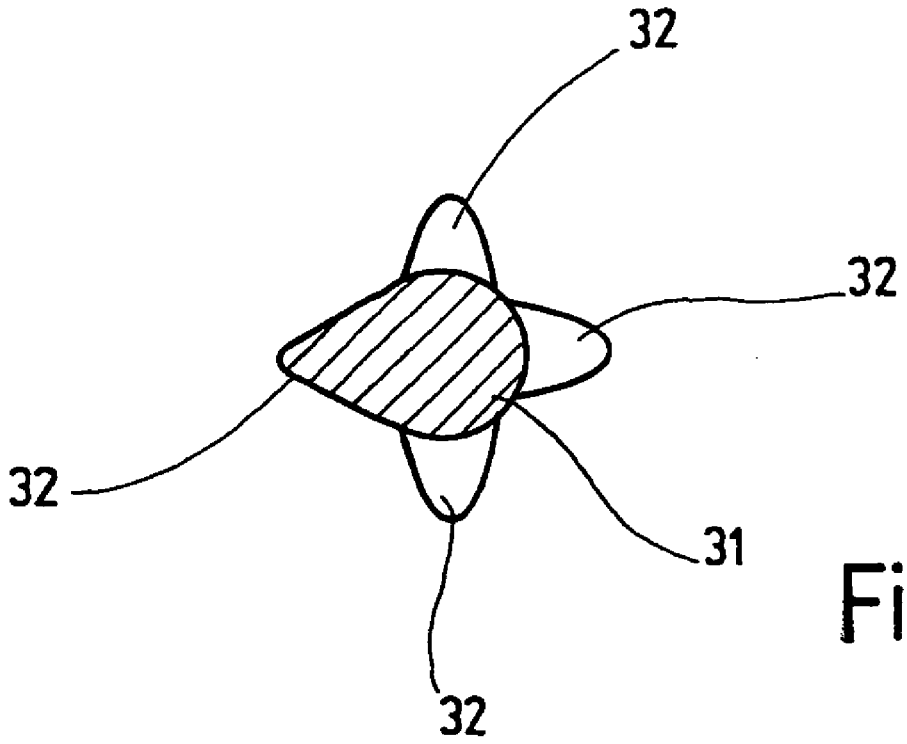
FIG. 5 is a transverse section of the core element shown in FIG. 4, taken at the level of one of the protrusions.
Figure 7:
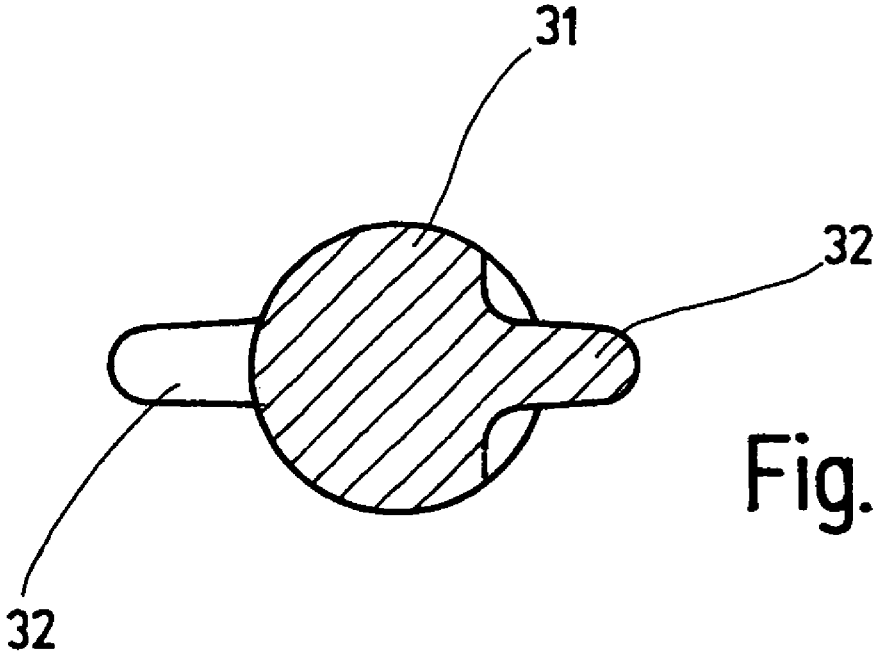
FIG. 7 is a transverse section of the core element shown in FIG. 6 taken at the level of one of the protrusions.

The core element 22 depicted in FIG. 3 comprises a straight shaft 31, whose diameter is markedly less than the inside cylindrical diameter of the helical spring 14. Bumplike extensions or humps 32 are located along a helical line on the outside of the shaft 31. In this case, the bumps or extensions 32 are offset from one another by 90° each; that is, in projection, as shown in the cross section of FIG. 5, the result is a four-pointed star. Nevertheless, the greatest diameter in the region of each hump 32 is less than the diameter of the interior of the helical spring 14. However, since the projection of two diametrically opposed extensions 32 onto a plane that intersects the axis of the shaft 31 at a right angle is greater than the diameter, the helical spring 14 is forced out of its intrinsic rectilinear shape into a shape in the form of a helical line.

The height of the hump 32, as measured in the radial direction relative to the axis of the shaft 31, and the spacing of the extensions 32, as measured in the longitudinal direction of the shaft 31, define the force with which the helical spring 14 rests on the crests of the extensions 32.

Figure 6:
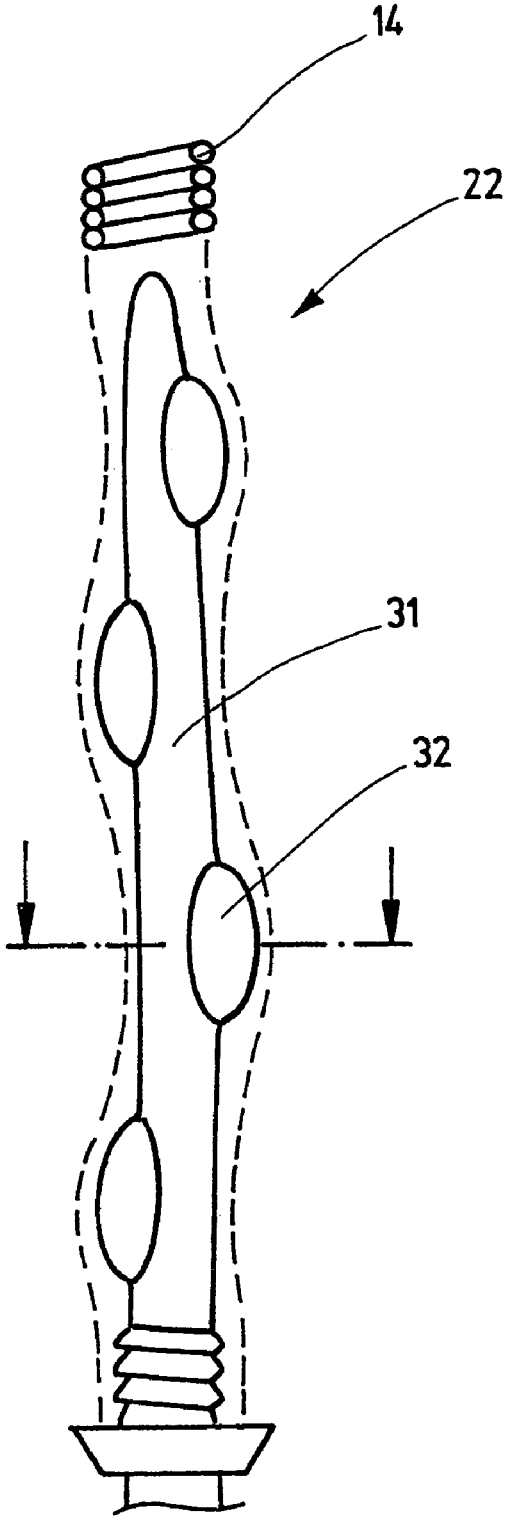
FIG. 6 is an enlarged view of another embodiment of core element in which protrusions are created by local deformation of the core element.

Still another alternative embodiment of a core element 22 is depicted in FIGS. 4 and 5, which again comprises a one-piece plastic molded part with bumplike extensions 32 integrally formed thereon. Their axial length in this case is less than their axial spacing from one another. Instead of integrally forming the bumplike protrusions 32 onto a plastic molded part, alternatively as shown in FIG. 6, the core element 22 may have a shaft 31 originally in the form of a cylindrical metal wire with the protrusions or humps 32 being formed therein by laterally crimping the starting material, so that the material is positively displaced radially outward with the cross section shown in FIG. 4. This creates "ears" which protrude radially past the contour of the originally circular cross section. The effect is the same as is described above for the exemplary embodiment of FIG. 2.

The invention claimed is:

1. A shedding device (1) for a loom, such as a jacquard loom, comprising a heddle (8) which includes an eyelet (9) from which heddle shafts (12, 13) extend on diametrically opposed sides, a drive device for longitudinally moving said heddle (8), one of said heddle shafts (12) being coupled with said drive device (2) and the other of said heddle shafts (13) having a connecting device (27), an elongated helical spring (14) having one end mounted on said connecting device (27) for moving said heddle (8) in a retracting direction, an anchor (16) fixedly anchoring the other end of the helical spring (14); and a longitudinally extending damping element (22) having a nonrectilinear shape defined by a plurality of longitudinally spaced protrusions in contact with said helical spring at at least a corresponding plurality of longitudinally spaced-apart points for forcing and causing the helical spring to take a nonrectilinear shape along an elongated length thereof.

2. The shedding device of claim 1 in which said damping element (22) is a longitudinally extending core element disposed in the helical spring (14).

3. The shedding device of claim 2 in which the diameter of the core element (22), as measured at the height of a given protrusion (32) is less than the inside diameter of the helical spring (14).

4. The shedding device of claim 2 in which said protrusions are defined by an undulating shape of the core element (22).

5. The shedding device of claim 2 in which said core element (22) is shaped in undulating fashion with said protrusions defined by undulations located in common planes.

6. The shedding device of claim 2 in which said core element (22) has a cross section that is substantially constant over the length thereof.

7. The shedding device of claim 2 in which said core element (22) has planar sides with two edges parallel to one another in an undulating line, and the undulating line has an amplitude, measured between a trough (23) and a crest (24), that is between 0.1 and 3 mm.

8. The shedding device of claim 7 in which a spacing between a crest (24) and a trough (23) of the undulating line is between 2 and 20 mm.

9. The shedding device of claim 7 in which the undulating line defined by the core element (22) includes at least one complete undulation.

10. The shedding device of claim 3 in which said protrusions (32) protrude alternately from different sides of the core element (22).

11. The shedding device of claim 3 in which said protrusions (32) are integral with the core element (22).

12. The shedding device of claim 3 in which said protrusions (32) are created by local crimping of the core element (22).

13. The shedding device of claim 3 in which said protrusions (32) have a spacing from one another of between 5 mm and 30 mm.

14. The shedding device of claim 3 in which said protrusions (32) have a spacing from one another of between 5 mm and 20 mm.

15. The shedding device of claim 2 in which said core element is made of a thermoplastic material.

16. The shedding device of claim 15 in which said shedding device is made of one of polyamide, polyethylene, or polyurethane.

17. The shedding device of claim 2 in which said core element is made of a metal, ceramic, pressure setting plastic or vulcanized material.

18. The shedding device of claim 1 in which said damping element (22) is integrally formed with one of the anchoring device (16) or connecting device (12).

19. The shedding device of claim 1 in which said connecting device (27) is a plastic molded part at an end of that other heddle shaft (13).

20. The shedding device of claim 18 in which the connecting device (27) has a thread (29).

21. The shedding device of claim 1 in which such anchoring device (16) has a thread (21).

22. The shedding device of claim 18 in which said thread (29) comprises a male threaded section.

23. The shedding device of claim 21 in which said thread (21) comprises a male threaded section.

24. The shedding device of claim 2 in which said core elements (22) have discrete protrusions spaced from one another along the length thereof, and said core element tapers inwardly toward a free end thereof.

25. The shedding device of claim 24 in which said core element (22) has a diameter over a length thereof that is at least as great as the inside diameter of the helical spring (14) and which decreases in diameter at a free end to a diameter less than the inside diameter of said helical spring (14).

26. The shedding device of claim 1 in which said helical spring (14) is a helical tension spring in which individual windings of the spring rest on one another in a relaxed state.

27. The shedding device of claim 1 in which said helical spring (14) is made of steel thread.

28. A shedding device (1) for a loom, such as a jacquard loom, comprising a heddle (8) which includes an eyelet (9) from which heddle shafts (12, 13) extend on diametrically opposed sides, a drive device for longitudinally moving said heddle (8), one of said heddle shafts (12) being coupled with said drive device (2) and the other of said heddle shafts (13) having a connecting device (27), a helical spring (14) having one end mounted on said connecting device (27) for moving said heddle (8) in a retracting direction, an anchor (16) fixedly anchoring the other end of the helical spring (14); and a helical shaped damping core element (22) disposed in said helical spring (14) in contact with said helical spring at at least a plurality of spaced-apart points for forcing and causing the helical spring to take a non-rectilinear shape.

29. A shedding device (1) for a loom, such as a jacquard loom, comprising a heddle (8) which includes an eyelet (9) from which heddle shafts (12, 13) extend on diametrically opposed sides, a drive device for longitudinally moving said heddle (8), one of said heddle shafts (12) being coupled with said drive device (2) and the other of said heddle shafts (13) having a connecting device (27), a helical spring (14) having one end mounted on said connecting device (27) for moving said heddle (8) in a retracting direction, an anchor (16) fixedly anchoring the other end of the helical spring (14); and a damping core element (22) disposed in said helical spring (14) having protrusions disposed along a helical line in contact with said helical spring at at least a plurality of spaced-apart points for forcing and causing the helical spring to take a nonrectilinear shape.

* * * * *

UNITED STATES PATENT AND TRADEMARK OFFICE

CERTIFICATE OF CORRECTION

PATENT NO. : 7,036,532 B2
APPLICATION NO. : 10/477652
DATED : May 2, 2006
INVENTOR(S) : Hans-Jürgen Bauder and Helmut Weinsdörfer It is certified that error appears in the above-identified patent and that said Letters Patent is hereby corrected as shown below:

On the first page, line 73, the Assignee name should read "Deutsche Institute für --Textil - und -- Faserforschung"

Signed and Sealed this

Twenty-ninth Day of August, 2006

JON W. DUDAS
*Director of the United States Patent and Trademark Office*